US007581987B2

(12) United States Patent
Guzzo, Jr. et al.

(10) Patent No.: US 7,581,987 B2
(45) Date of Patent: Sep. 1, 2009

(54) SPLITTER BALUN WITH REPOSITIONAL CONNECTOR

(75) Inventors: Louis J. Guzzo, Jr., Inman, SC (US); Anthony L. Nieves, Fountain Inn, SC (US)

(73) Assignee: AFL Telecommunications LLC, Spartanburg, SC (US)

( * ) Notice: Subject to any disclaimer, the term of this patent is extended or adjusted under 35 U.S.C. 154(b) by 0 days.

(21) Appl. No.: 11/441,125

(22) Filed: May 26, 2006

(65) Prior Publication Data

US 2007/0273455 A1 Nov. 29, 2007

(51) Int. Cl.
*H01R 9/05* (2006.01)

(52) U.S. Cl. ..... 439/578; 439/620.03

(58) Field of Classification Search ..... 439/607, 439/609, 610, 578, 620.03
See application file for complete search history.

(56) References Cited

U.S. PATENT DOCUMENTS

| | | | | | |
|---|---|---|---|---|---|
| 4,477,144 | A | * | 10/1984 | Huang | 439/581 |
| 4,648,682 | A | * | 3/1987 | Tubbs | 439/391 |
| 4,713,024 | A | * | 12/1987 | Hatakeyama et al. | 439/555 |
| 4,945,559 | A | | 7/1990 | Collins et al. | |
| 4,979,209 | A | | 12/1990 | Collins et al. | |
| 5,240,436 | A | * | 8/1993 | Bradley et al. | 439/654 |
| 5,639,262 | A | * | 6/1997 | Lim | 439/607 |
| 5,703,944 | A | * | 12/1997 | DeBalko | 379/413.03 |
| 6,398,584 | B1 | * | 6/2002 | Hua et al. | 439/578 |
| 6,786,757 | B2 | * | 9/2004 | Pocrass | 439/418 |
| 6,955,560 | B1 | * | 10/2005 | Biggs | 439/536 |
| 7,147,517 | B1 | * | 12/2006 | Kern et al. | 439/638 |
| 2006/1009985 | | * | 5/2006 | Ames | 439/638 |
| 2006/0225119 | A1 | * | 10/2006 | Wollmershauser et al. | 725/121 |

* cited by examiner

*Primary Examiner*—David Vu
*Assistant Examiner*—Earl N Taylor
(74) *Attorney, Agent, or Firm*—Sughrue Mion, PLLC

(57) ABSTRACT

As networking demands only increase for both home and business uses, the need for a splitter balun which enables repositioning of coaxial connections in the non-axial directions and provides universal positioning to interface jacks is highly desirable. For some applications, the challenge is to provide a splitter which provides a means of repositioning input and output connections via an easy modification or manipulation of the splitter. For still further applications, it is desirable to securely mount the coax jack within the balun housing. The apparatus and method described herein meet these challenges and others, in part, by placing a bracket around the coaxial connection and providing multiple mounts for securing the bracket within the balun housing. Mounts are provided at opposite ends of the balun housing allowing the output connection direction to be readily reversed. The positive effects of this apparatus and method include having only one splitter balun on hand to connect to interfaces in either of opposite directions.

14 Claims, 8 Drawing Sheets

SPLITTER BALUN WITH REPOSITIONAL CONNECTOR

BACKGROUND OF THE INVENTION

Coaxial cable splitters are used at coaxial cable branch points where the even distribution of power and impedance matching are both important. Conventional power splitters are available with different numbers of output ports. However, conventionally, power splitters are built upon the basic one input-to-two outputs component. Conventional coaxial cable splitters connect readily to standard BNC or F jacks.

Conventional video baluns are designed to convert a baseband video signal via BNC or F (coaxial cable) male connector, to an 18-22 gauge twisted pair (Cat 5) via an RJ-45 connector. A reciprocal passive balun can by used to convert the video signal on the Cat 5 cabling input to a coaxial cable compatible BNC or F output. A video balun will allow residential S video equipment to be connected through Cat 5 cabling. Multiple Video signals may be transmitted adjacent to one another using multipair Cat 5 cabling.

Some conventional splitter baluns only provide rotation of attached coaxial cables in the axial direction of the coaxial cable, shown for Example in FIG. 1A. Repositioning of the connector at the input and output cable connections, or in the splitter itself, is not afforded in alternate directions. Other conventional baluns afford repositioning of the coaxial cable connection, but do not provide anchoring of the coax jack (71) in the balun housing (31), as shown for example in FIG. 1B.

The multitude of different commercial modules and network interfaces require a corresponding multitude of different jack interfaces. A multitude of different splitters and splitter baluns, each compatible with the different connector positioning requirements, is needed to provide connections in and between the different modules and network interfaces. In turn, businesses and users needing to make connections to the different modules and network interfaces must have numerous different splitter baluns on hand or must acquire the specifically configured splitter balun to make the various connections.

Repositioning of an output or an input on a splitter balun in non-axial directions may be desirable for numerous reasons to include relative positions of existing equipment, mounting restrictions, or other housing requirements. For example, a splitter balun may be required which has a twisted pair input coming in on the horizontal, while the output BNC or F connection needs to be made in the vertical direction.

As networking demands only increase for both home and business uses, the need for splitter baluns which enable repositioning of the splitter in non-axial directions and provide universal positioning to interface jacks are highly desirable.

For some applications, the challenge is to provide a splitter which enables repositioning of input and output connectors via an easy modification or manipulation of the splitter.

For further applications, simple repositioning, in addition to axial rotation, of the output connector alone on a splitter balun is desirable.

For still further applications, anchoring of the coaxial cable connector to the balun housing is also desirable in some applications. The need to anchor the coaxial cable connector arises from a variety of applications and conditions to include control of mechanical loading and protection from the environment. The coaxial cable connection may be housed in, for example, an exterior wall box or other housing located in a corrosive environment.

SUMMARY OF THE INVENTION

The present invention provides an apparatus and method for a splitter balun connecting from a twisted pair to a coaxial cable in non-axial relative directions, wherein the direction of the coax connector can be quickly and easily modified.

It is an object of the present invention to accommodate a horizontal input and a vertical output relative to the horizontal input and vice versa.

It is another object of the present invention to provide an apparatus which affords a quick transition of output position relative to the input position in a non-axial input cable position.

In accordance with the objects of the present invention, in a splitter balun apparatus according to an exemplary embodiment of the present invention, the direction of the BNC or F output connector can be easily modified to face the opposite direction and secured to maintain that position.

In accordance with the objects of the present invention, in a splitter balun apparatus according to an exemplary embodiment of the present invention, the direction of the BNC or F output connector can be quickly reversed to face the opposite direction.

In an apparatus according to another exemplary embodiment, the direction of the BNC or F connector can be easily rearranged to face a direction off axis of the twisted pair lines and anchored to maintain the off axis position within the balun housing.

In accordance with the objects of the present invention, in a splitter balun apparatus according to another exemplary embodiment, there is the capability to reverse the direction of the BNC or F output connector to face the opposite direction within the balun housing of the exemplary apparatus and without the use of external components.

A method in accordance with an exemplary embodiment of the present invention comprises repositioning the bracket of the BNC or F connector from a first end of the balun housing to an opposite end of the balun housing to change the direction that the BNC or F connector faces.

A method in accordance with an exemplary embodiment of the present invention comprises mounting the splitter balun housing within a wallbox.

A method in accordance with an exemplary embodiment of the present invention comprises quickly repositioning the BNC or F output connector to face the opposite direction and mounting the splitter balun housing in a compatible wallbox.

In summary, the new invention differs from existing technology in that it incorporates packaging which enables connections between different manufacturer's network interface device boxes when a coax connector is introduced to the subscriber line module.

The new invention incorporates packaging that allows movement or repositioning of the coax connector in the packaged module while maintaining all applicable functionality. Existing technology does not support this application.

The new invention incorporates an optional registered jack interface into multiple manufacturer's network interface device boxes into the aforementioned packaging, without any loss of feature or fit. Existing technology does not support this application or allow for this feature.

The new invention allows end users to minimize inventory and control purchased items by using one module supporting usage in multiple manufacturer's network interface device boxes. This accomplished through movement or repositioning of the coax connector on the module, and including an optional registered jack interface. Fewer materials will have to be sourced and stocked, resulting in increased efficiencies, lower inventories, and higher standard of craftsmanship in the field due to familiarity with a consolidated product.

Other objects and advantages of the present invention will become apparent to one skilled in the art from the following description in view of the accompanying drawings.

DETAILED DESCRIPTION OF THE INVENTION

The present invention affords simple repositioning, in addition to axial rotation, of the output connector of a splitter balun. In addition, anchoring of the coaxial cable connector to the balun housing is also provided in accordance with the apparatus and methods of the present invention.

Figure 1A:
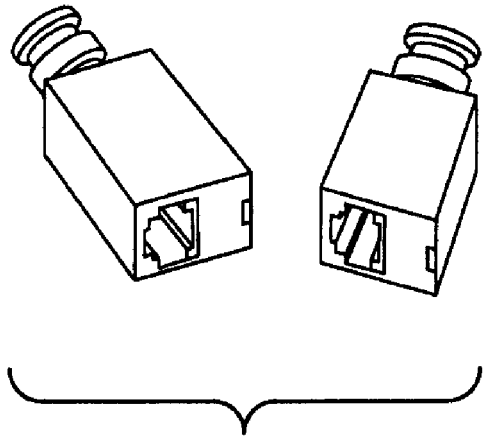
FIG. 1A PRIOR ART
FIG. 1 shows a conventional splitter balun wherein repositioning of the coaxial cable connection is afforded only in the axial direction.
Figure 1B:
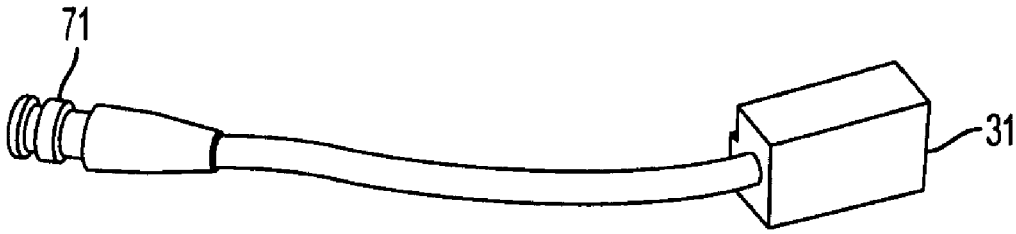
FIG. 1B PRIOR ART
Figure 2A:
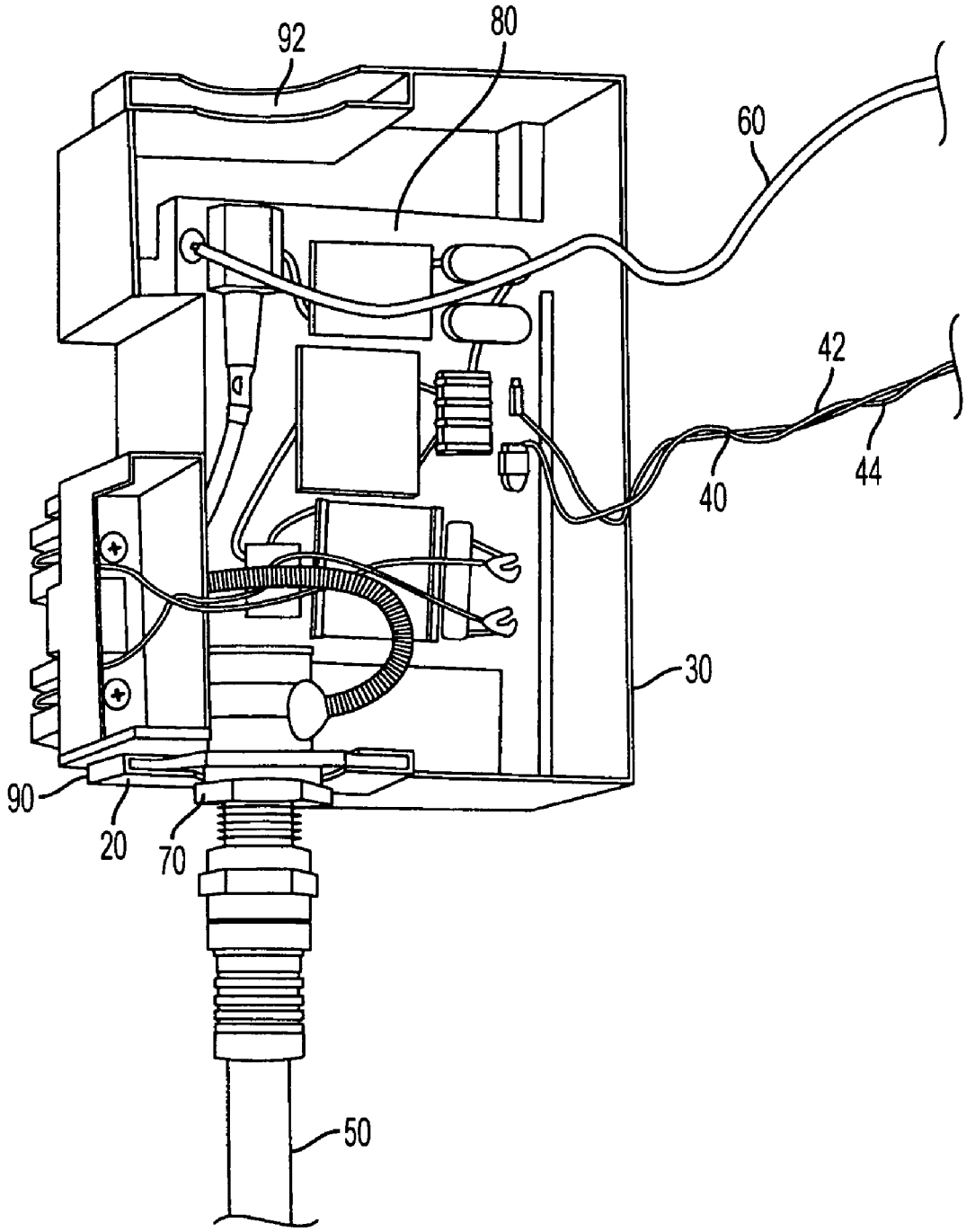
FIG. 2A is a splitter balun in accordance with an exemplary embodiment of the present invention wherein the coaxial connector is anchored to the bottom of the balun housing and faces outward while the twisted pair enters the balun housing from the right.

Turning first to FIG. 2A, an exemplary embodiment of the present invention is shown. Twisted pair lines 40 comprising hi 42 and lo 44 lines enter the balun housing 30 from the right and are connected to the conversion circuitry 80. The output of the conversion circuit is connected to the coaxial connector 70. A bracket 20 is mounted on the coaxial connection and fits securely into a bracket slot, 90 and 92. In FIG. 2A the bracket is shown mounted in the bottom slot 90. A ground line 60 also enters the balun housing from the right and connects to the conversion circuitry. Coaxial cable 50 is shown connected to the coaxial connector 70 and extends axially from connector 70 and at a right angle to the input of the twisted pair 40.

Figure 2B:
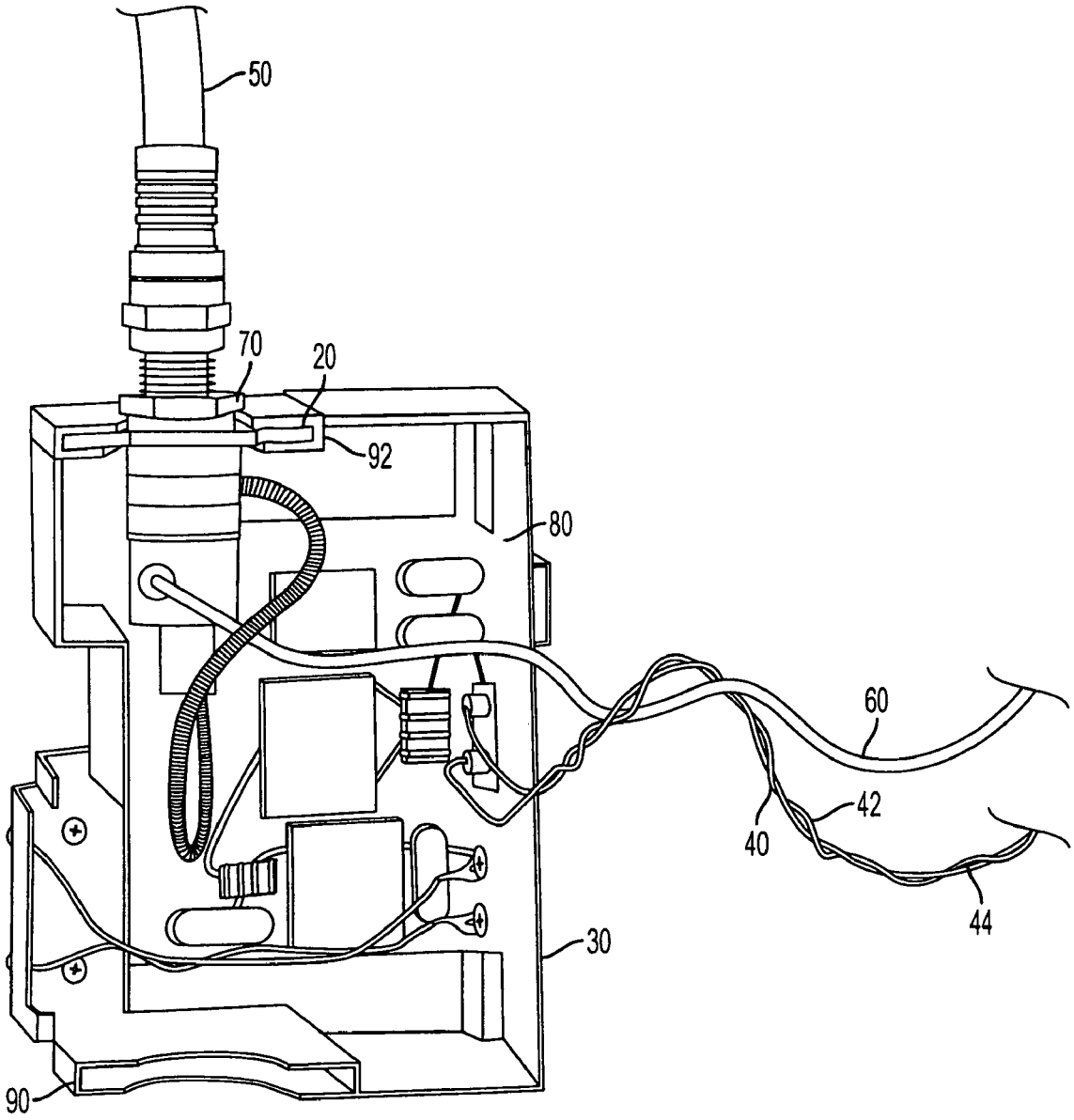
FIG. 2B is a splitter balun in accordance with an exemplary embodiment wherein the coaxial connector is anchored to the top of the balun housing and faces outward and the twisted pair enters the balun housing from the right.

FIG. 2B shows the splitter balun apparatus of FIG. 2A, wherein the coaxial connector 70 is mounted in the top of the balun housing 30 and faces outward. Using a simple method in accordance with an exemplary embodiment of the present invention, the bracket 20 on the coaxial connector 70 is secured in the top bracket slot 92. Bracket 20 fits snugly into slot 92 and is inserted straight and secured by the tightness of the fit of the bracket 20 in the slot 92. Coaxial cable 50 is shown connected to the coaxial connector 70 and extends axially from the connector 70 and at an opposite right angle to the input of the twisted pair 40, as compared to the coaxial connector 70 direction in FIG. 2A.

Figure 3A:
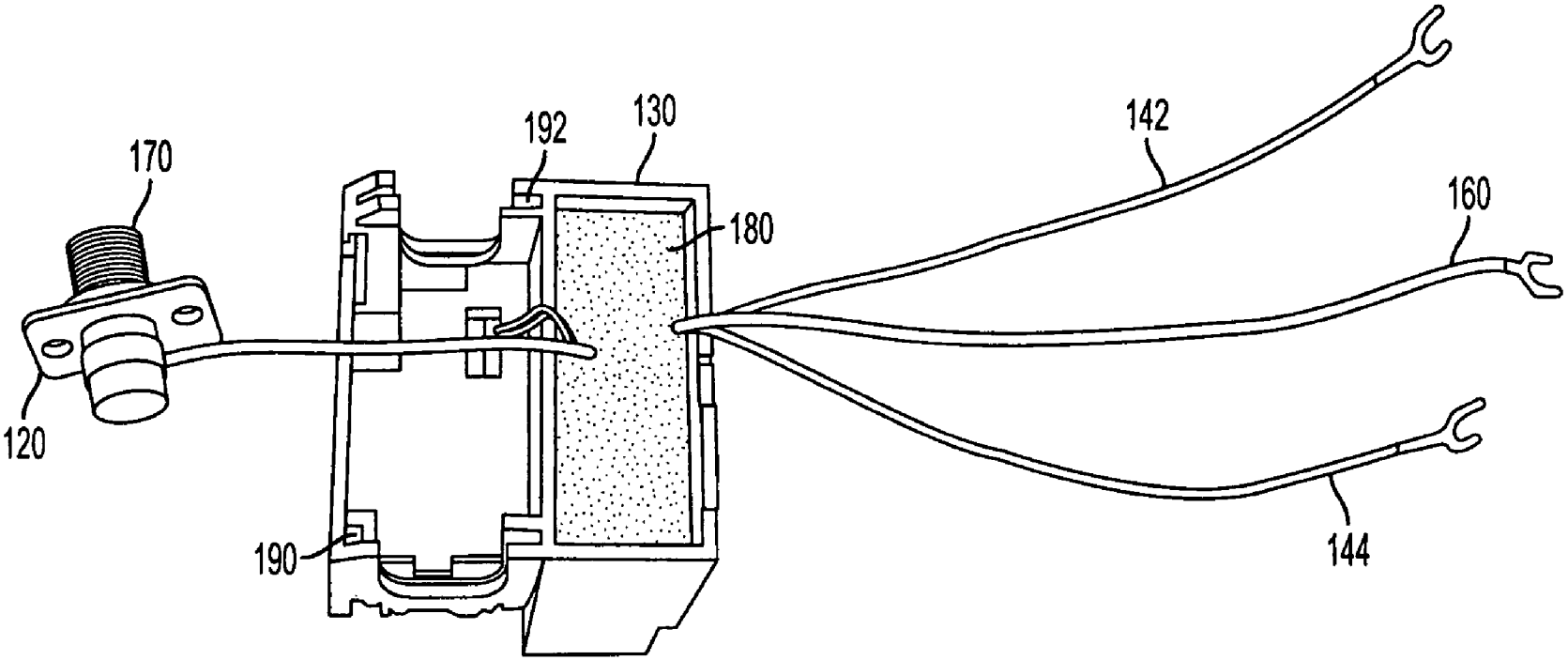
FIG. 3A is bottom view of a splitter balun in accordance with another exemplary embodiment of the present invention showing a top and a bottom slot in the balun housing for the coaxial connector bracket wherein the balun housing partitions the conversion circuitry from the coaxial connection.

FIG. 3A is a bottom view of a splitter balun in accordance with another exemplary embodiment of the present invention. Balun housing 130 partitions the conversion circuitry 180 from the coaxial connection 170. Bottom and top slots 190 and 192, respectively, are provided for mounting of the bracket 120. Hi and lo lines 142 and 144, respectively, are shown entering the balun housing 130 from the right and connect to the conversion circuitry 180. Grounding wire 160 also enters the conversion circuitry from the right.

Figure 3B:
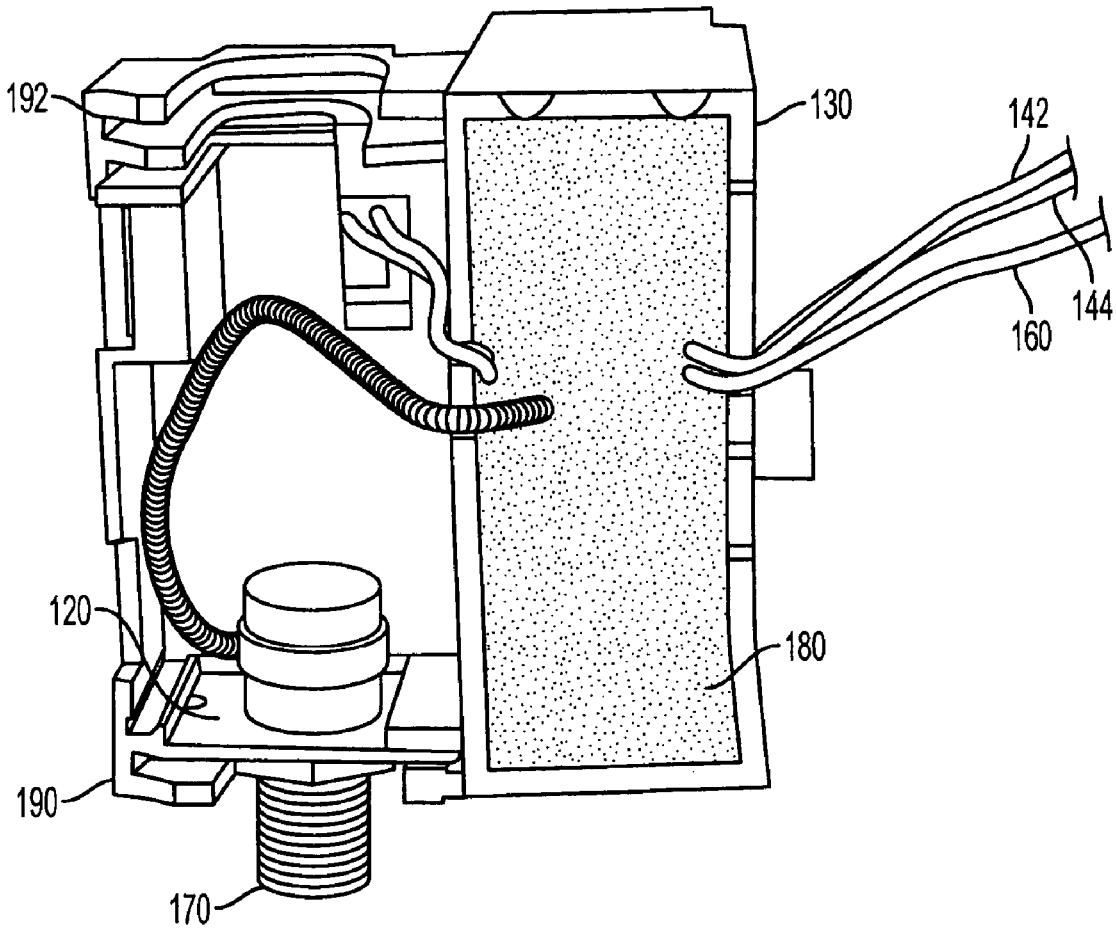
FIG. 3B is a splitter balun in accordance with the exemplary embodiment of FIG. 3A, wherein the coaxial connector bracket is mounted in the bottom bracket slot of the balun housing.

FIG. 3B shows the splitter balun apparatus of FIG. 3A, wherein the coaxial connector 170 is mounted in the bottom slot 190 and faces outward. The bracket 120 is anchored, being secured in the bottom slot 190 of the balun housing 130.

Figure 4A:
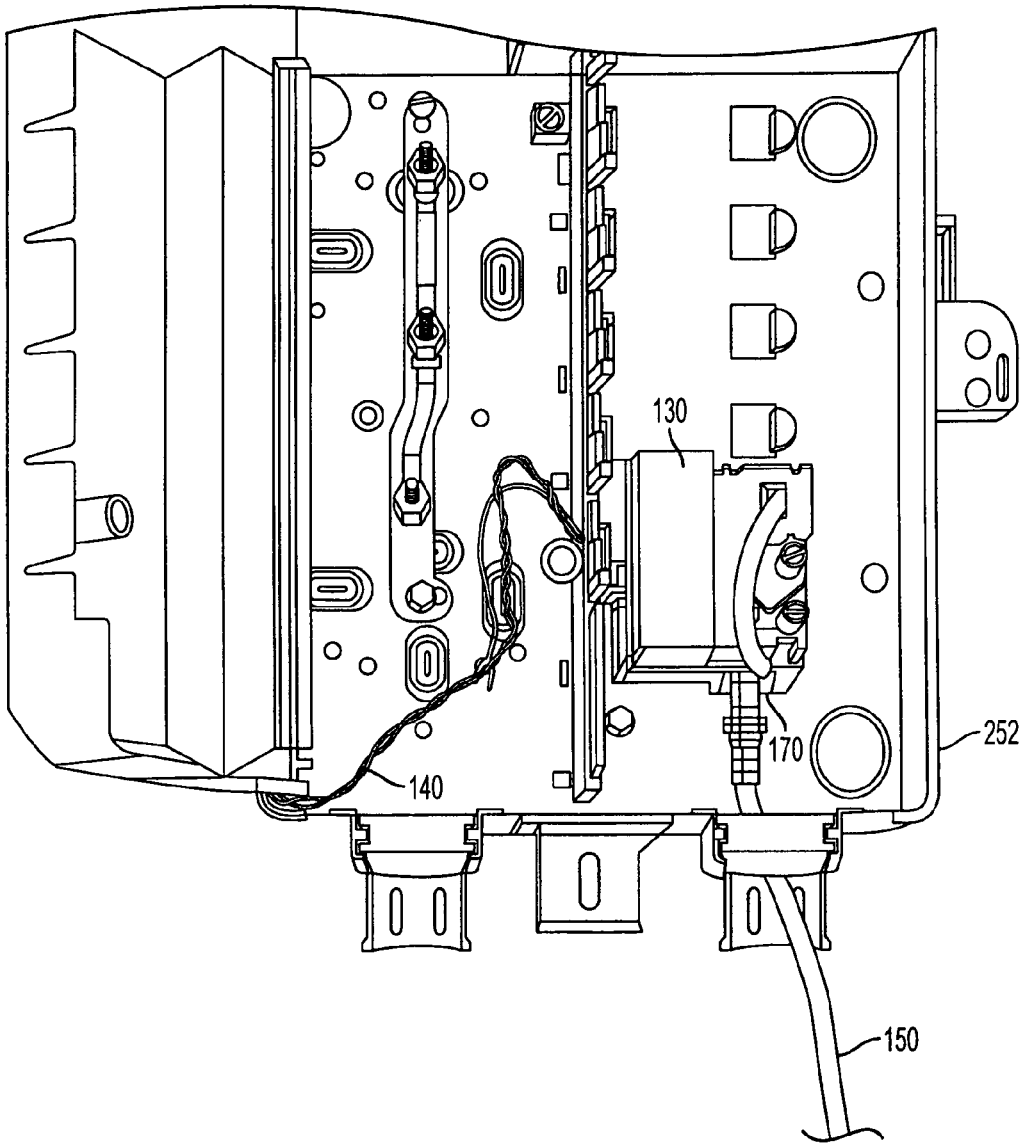
FIG. 4A is another exemplary embodiment of the present invention wherein the coaxial cable connector is anchored to the top of the balun housing, which is in turn flip to provide twisted pair entry from the left as viewed, wherein the balun housing is in mounted in a right wall box and the coaxial cable connector direction faces downward and exits the bottom right of the wall box.

FIG. 4A shows a top view of the exemplary splitter balun embodiment shown in FIG. 3B, wherein the balun housing 130 is flipped over about the vertical so that the twisted pair 140 enters the balun housing 130, as viewed from the top, from the left and the coaxial connection 170 protrudes out the bottom. In the exemplary embodiment of FIG. 4A, the balun housing 130 is mounted in a right wall box 252, wherein the coaxial cable 150 extends out the bottom right of the right wall box 252.

Figure 4B:
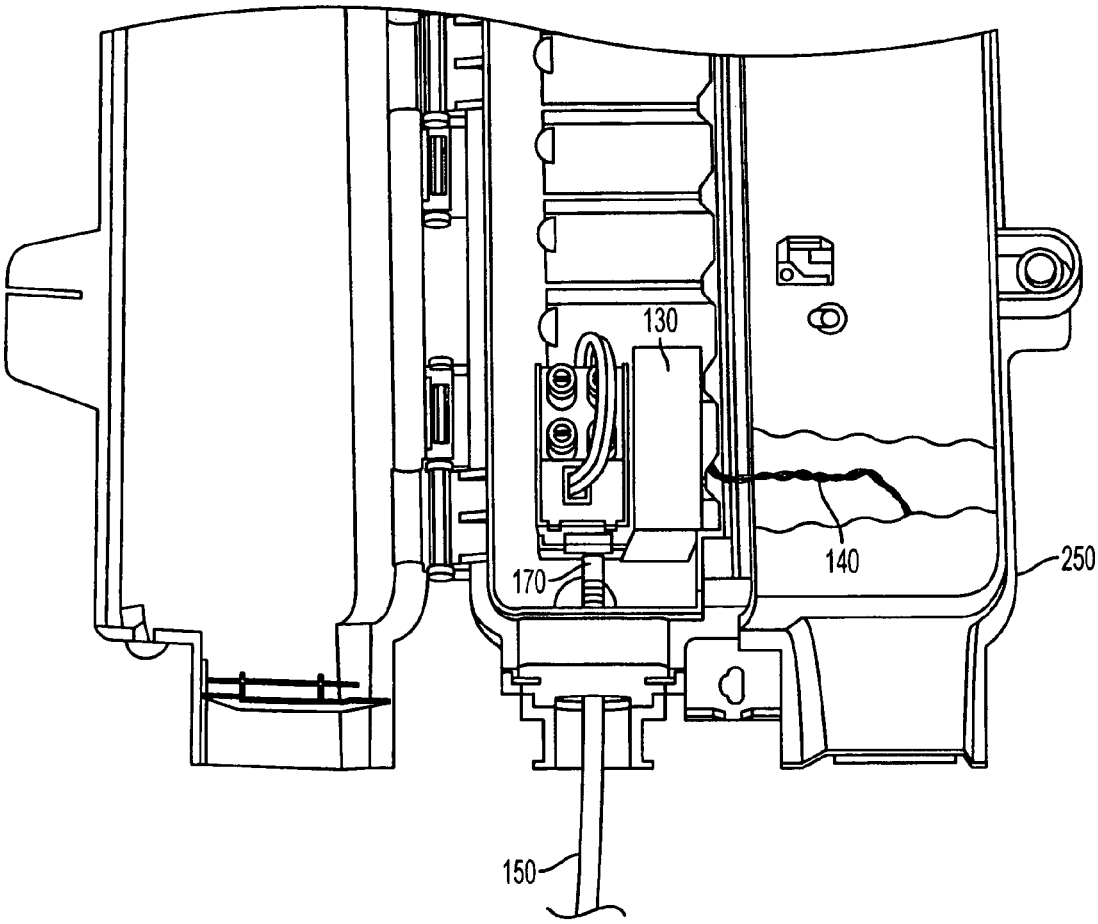
FIG. 4B is another exemplary embodiment of the present invention wherein the coaxial cable connector is anchored to the bottom of the balun housing and provides twisted pair entry from the right as viewed, wherein the balun housing is in mounted in a left wall box and the coaxial cable connector direction faces downward and exits the bottom left of the wall box.

FIG. 4B shows a top view of the exemplary splitter balun embodiment shown in FIG. 3B, wherein the balun housing 130 is flipped over about the horizontal so that the twisted pair 140 enters the balun housing 130, as viewed from the top, from the right and the coaxial connection 170 protrudes out the bottom. In the exemplary embodiment of FIG. 4B, the balun housing 130 is mounted in a left wall box 250, wherein the coaxial cable 150 extends out the bottom right of the left wall box 250.

Figure 5B:
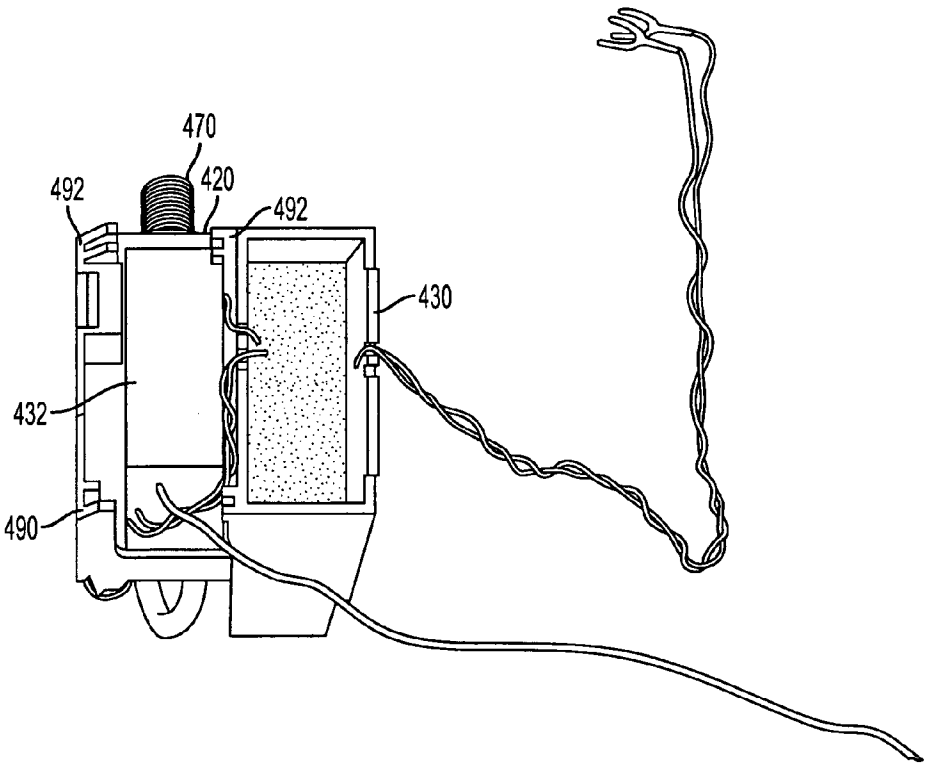
FIG. 5B shows another exemplary embodiment of the present invention, wherein the balun housing partitions the conversion circuitry from the coax connector, the coax connector bracket is connected to a filter enclosure and the bracket for anchoring the coax connector is mounted in the bottom bracket slot while the coax connector protrudes out of the top of the balun housing facing outwards.
Figure 5A:
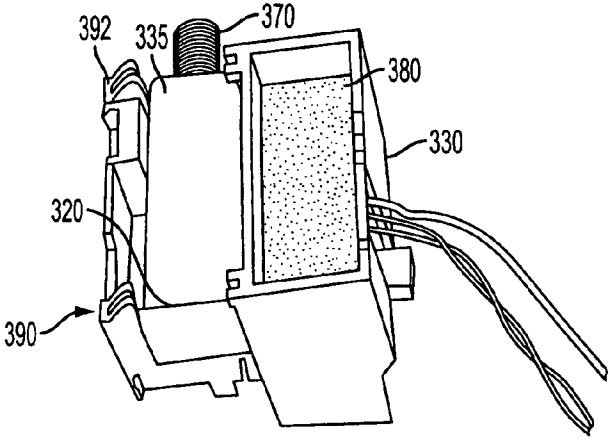
FIG. 5A shows another exemplary embodiment of the present invention, wherein the balun housing partitions the conversion circuitry from the coax connector and the bracket for anchoring the coax connector is mounted in the bottom bracket slot while the coax connector protrudes out of the top of the balun housing facing outwards.

FIG. 5A shows a splitter balun in accordance with another exemplary embodiment of the present invention, wherein the balun housing 330 partitions the conversion circuitry 380 from coaxial connection 370. The bracket 320 is mounted in the bottom slot 390, while the coaxial connector 370 faces outward, extending out the top of the balun housing 330. A coaxial connection housing 335 provides the connection between bracket 320 and the coaxial connector 370.

FIG. 5B shows a splitter balun in accordance with another exemplary embodiment, wherein the balun housing 430 partitions the conversion circuitry 480 from the coaxial connection 470. The bracket 420 is mounted in the top slot 492 while the coaxial connection 470 faces outward, extending out the top of the balun housing 430.

FIGS. 2A, 2B, 3A, 5A, and 5B show only exemplary embodiments of many possible means for securing the coaxial connection to the balun housing. Alternate means such as fastening the bracket to balun housing using a fastener will be readily appreciated by one of ordinary skill in the art. The bracket can be made from any material having sufficient strength to support the forces required to maintain the coaxial connector in a fixed position once secured. While the exemplary embodiments of the present invention comprise a rectangular slot to mount the bracket into alternate satisfactory configurations are readily apparent to one of ordinary skill in the art. Alternate shapes of brackets are also readily apparent to one of skill and the brackets shown in the Figs. are only exemplary. One ordinarily skilled in the art will readily appreciate the various ways of physically securing the coaxial connector to the balun housing while permitting adequate electrical connection.

The coaxial connection housing 335 and 432 of FIGS. 5A and 5B, respectively, can be made from metal, plastic, resin, or polymer. The bracket itself can likewise be made of metal, plastic, or other material of comparable strength and rigidity.

The balun housing, i.e. element 30 in FIG. 2A, can be made of any plastic, polymer, or resin type material having sufficient rigidity to form the housing and maintain the formed balun housing shape. The shape and size of the balun housing according to the present invention can also vary as dictated by physical constraints into which the splitter balun is employed.

In summary, the challenge is to provide a splitter balun which enables repositioning of input and output connectors via an easy modification or manipulation of the splitter balun. While the present invention has been particularly shown and described according to exemplary embodiments herein, it will be understood by those skilled in the art that various changes can be made in form or detail without departing from the spirit and scope of the invention as defined by the following claims.

What is claimed is:

1. A splitter balun comprising:

at least one opening for a twisted pair, a first and a second opening for a coaxial cable, a balun housing, and a connecting means in said balun housing for connecting a coaxial cable to said first opening, wherein said connecting means can be repositioned to connect a coaxial cable to said second opening.

2. The splitter balun according to claim 1, wherein said first and second openings are on opposite sides of said balun housing.

3. The splitter balun according to claim 1, wherein said first and second openings are the same side of said balun housing.

4. The splitter balun according to claim 1, wherein said connecting means can be repositioned while maintaining an electrical connection between a coaxial cable and a twisted pair.

5. A splitter balun comprising:

an opening for a twisted pair, a first and second opening for a coaxial cable, a balun housing, and a bracket in said balun housing for connecting a coaxial cable to said first opening wherein said bracket can be repositioned to connect a coaxial cable to said second opening.

6. A splitter balun according to claim 5, further comprising:

at least two slots in the balun housing, wherein the bracket can be secured.

7. The coaxial cable splitter balun of claim 6, wherein the bracket is press fit into one of the at least two slots.

8. The coaxial cable splitter balun of claim 6, wherein the bracket is secured via a fastener into one of the at least two slots.

9. The coaxial cable splitter balun of claim 7, wherein the bracket has threads and the output port has corresponding threads.

10. The coaxial cable splitter balun of claim 5, wherein the balun housing is made from any of a plastic, a polymer, or a metal.

11. The coaxial cable splitter balun of claim 5, wherein the bracket is made from any of a plastic, a polymer, or a metal.

12. The splitter balun according to claim 5, wherein said first and second openings are on opposite sides of said balun housing.

13. The splitter balun according to claim 5, wherein said first and second openings are on the same side of said balun housing.

14. The splitter balun according to claim 5, wherein said bracket can be repositioned while maintaining an electrical connection between a coaxial cable and a twisted pair.

* * * * *